US008391519B2

(12) United States Patent
Chen

(10) Patent No.: US 8,391,519 B2
(45) Date of Patent: Mar. 5, 2013

(54) TREBLE BASS COAXIAL LOUDSPEAKER

(75) Inventor: Ting-Pang Chen, Taipei (TW)

(73) Assignee: Greness Enterprise Co., Ltd., Taipei City (TW)

( * ) Notice: Subject to any disclaimer, the term of this patent is extended or adjusted under 35 U.S.C. 154(b) by 79 days.

(21) Appl. No.: 13/180,837

(22) Filed: Jul. 12, 2011

(65) Prior Publication Data

US 2013/0016866 A1 Jan. 17, 2013

(51) Int. Cl.
*H04R 25/00* (2006.01)

(52) U.S. Cl. ..... 381/182; 381/186; 381/386

(58) Field of Classification Search ..... 381/89, 381/353, 354, 182, 186, 386, 396, 401, 402, 381/416, 432; 181/144, 147, 165, 199
See application file for complete search history.

(56) References Cited

U.S. PATENT DOCUMENTS 4,821,331 A * 4/1989 Murayama et al. ..... 381/407
5,548,657 A * 8/1996 Fincham ..... 381/182
6,393,132 B1 * 5/2002 Lin ..... 381/386

FOREIGN PATENT DOCUMENTS

TW 215755 11/1993

* cited by examiner

*Primary Examiner* — Huyen D Le
(74) *Attorney, Agent, or Firm* — Rabin & Berdo, P.C.

(57) ABSTRACT

A treble-bass coaxial loudspeaker has an inverted conical frame, a bass resonance assembly mounted to the bottom of the frame, a bracket, and a treble resonance assembly. The bracket is mounted on the bass resonance drumhead and contains the treble resonance assembly inside to separate the treble resonance chip from the bass resonance assembly below. In this way, when the bass resonance drumhead vibrates, the air turbulence between the bass resonance drumhead and the wave damping annular board decreases destruction of the joint strength between the treble resonance chip and the treble resonance drumhead.

18 Claims, 7 Drawing Sheets

TREBLE BASS COAXIAL LOUDSPEAKER

BACKGROUND OF THE INVENTION

1. Field of the Invention

The present invention relates to a treble-bass coaxial loudspeaker, and more particularly to a treble-bass coaxial loudspeaker with long life for use.

2. Description of Related Art

With reference to FIG. 7, a treble-bass coaxial loudspeaker is formed as a single speaker body capable of generating treble and bass sounds at the same time. The treble-bass coaxial loudspeaker comprises:

an inverted conical frame 60 having a top side, wherein the top side of the inverted conical frame 60 forms a circular opening 61 and a bass resonance assembly is mounted under the inverted conical frame 60, wherein the bass resonance assembly from top to bottom comprises a wave damping annular board 62, a top yoke 63, a magnet 64 and a bottom yoke 65; wherein a middle portion of the magnet 64 forms a through-hole for a middle convex cylinder 651 of the bottom yoke 65 to penetrate upwardly and to be fastened;

a bass resonance drumhead 66 having an upper edge, wherein the bass resonance drumhead 66 is in an inverted conical shape, wherein the upper edge of the bass resonance drumhead 66 is mounted to an inner edge of the circular opening 61 of the inverted conical frame 60, wherein a bottom end of the bass resonance drumhead 66 forms a center opening to align with the through-hole of the magnet 64 and to be fastened to the wave damping annular board 62;

a central shaft 67 having a bottom, wherein the bottom of the central shaft 67 penetrates downward from the circular opening 61 of the inverted conical frame 60 through the central opening of the bass resonance drumhead 66 and the wave damping annular board 62, wherein the central shaft is fastened to the top of the middle convex cylinder 651 of the bottom yoke 65 by a screw 68 downward from the bottom surface of the middle convex cylinder 651 of the bottom yoke 65 through the middle convex cylinder 651 and the central shaft 67, wherein the central shaft 67 is fastened to the middle convex cylinder 651; and a treble resonance assembly 70 comprising a treble resonance chip 71 and a treble resonance drumhead 72, wherein the bottom end of the treble resonance chip 71 is mounted at the top of the central shaft 67, wherein the treble resonance drumhead 72 is mounted on the top surface of the treble resonance chip 71. The treble resonance drumhead 72 is also in an inverted conical shape.

The central shaft 67 of the above treble-bass coaxial loudspeaker is penetratingly mounted into the bass loudspeaker central shaft. The treble resonance assembly 70 is mounted at the top surface of the treble-bass coaxial loudspeaker to generate treble sounds from the treble resonance drumhead 72 and generate bass sounds from the bass resonance drumhead 66 respectively. However, the treble quality of the coaxial loudspeaker is poor.

Therefore, an improved treble-bass coaxial loudspeaker is provided as shown in FIG. 8. The loudspeakers' structures are mostly the same in FIG. 7 and FIG. 8. The main difference between FIG. 7 and FIG. 8 is that there is no central shaft in FIG. 8. A top edge of the treble resonance drumhead 72*a* is fastened to the bass resonance drumhead 66. A blocking space is formed between the bass resonance drumhead 66 and the treble resonance drumhead 72*a*. The treble resonance chip 71 is mounted in the blocking space. The top surface of the treble resonance chip 71 is adhesive to the bottom end of the treble resonance drumhead 72*a*. The treble resonance chip 71 is suspended above the bottom surface of the treble resonance drumhead 72*a* to decrease the sonic resonance obstruction produced by the treble resonance chip 71 and to improve the treble quality.

Although the coaxial loudspeaker owns better treble quality, the treble resonance chip is only adhesively suspended to the bottom end of the treble resonance drumhead. Therefore, when the bass resonance drumhead vibrates, the air turbulence of the blocking space makes the treble resonance chip fall down easily from the treble resonance drumhead.

SUMMARY OF THE INVENTION

The main objective of the present invention is to provide a treble-bass coaxial loudspeaker which can prevent the treble resonance chip from falling down and prevent the treble-bass coaxial loudspeaker from losing the function of generating treble sounds. The present invention can effectively extend the life for use of the treble-bass coaxial loudspeaker.

To accomplish the objective, the treble-bass coaxial loudspeaker has an inverted conical frame, a bass resonance drumhead, a bracket, and a treble resonance assembly.

The inverted conical frame has a bass resonance assembly. A top side of the inverted conical frame forms a circular opening The bass resonance assembly from top to bottom has a wave damping annular board, a top yoke, a magnet and a bottom yoke. A middle portion of the top yoke and a middle portion of the magnet each respectively form a through-hole for a middle convex cylinder of the bottom yoke to penetrate upwardly and to be fastened.

The bass resonance drumhead is in an inverted conical shape and has an upper edge. The upper edge of the bass resonance drumhead is fastened to the inner side of a top opening of the inverted conical frame. A bottom end of the bass resonance drumhead forms a center opening to align with the through-hole of the magnet and for the bass resonance drumhead to be fastened to the wave damping annular board.

The bracket is mounted on the bass resonance drumhead.

A treble resonance assembly has a treble resonance chip, a treble resonance drumhead, and an elastomer.

The treble resonance chip is mounted in the bracket. The bottom surface of the treble resonance chip is mounted on the elastomer.

The treble resonance drumhead is in an inverted conical shape. The bottom of the treble resonance drumhead is mounted on the upper surface of the treble resonance chip.

The elastomer is mounted on the bottom of the bracket. A bottom end of the inverted conical treble resonance drumhead is mounted on a top surface of the treble resonance chip. The upper edge is fastened to a top opening of the bracket.

The bracket is mounted on the bass resonance drumhead and provides a space for the treble resonance assembly to separate the treble resonance chip from the space below between the bass resonance drumhead and the wave damping annular board. Thus, when the bass resonance drumhead vibrates, the air turbulence between the bass resonance drumhead and the wave damping annular board decreases destruction of the joint strength between the treble resonance chip and the treble resonance drumhead. Furthermore, although the treble resonance chip is not suspensory, the treble resonance chip is separated from the bottom of the bracket by the elastomer and is not in touch with the bracket directly. So the treble quality is still excellent.

DETAILED DESCRIPTION OF THE PREFERRED EMBODIMENT

Figure 1:
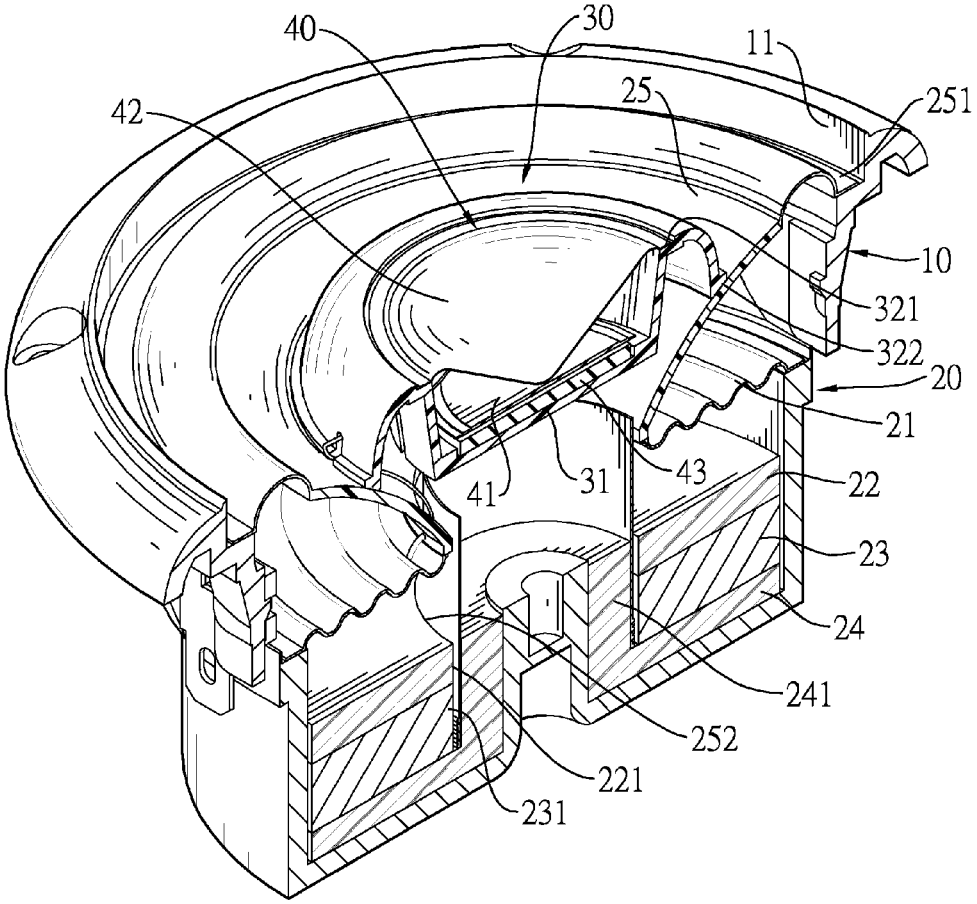
FIG. 1 is a perspective cross-section view of a preferred embodiment of a loudspeaker of the invention.
Figure 2:
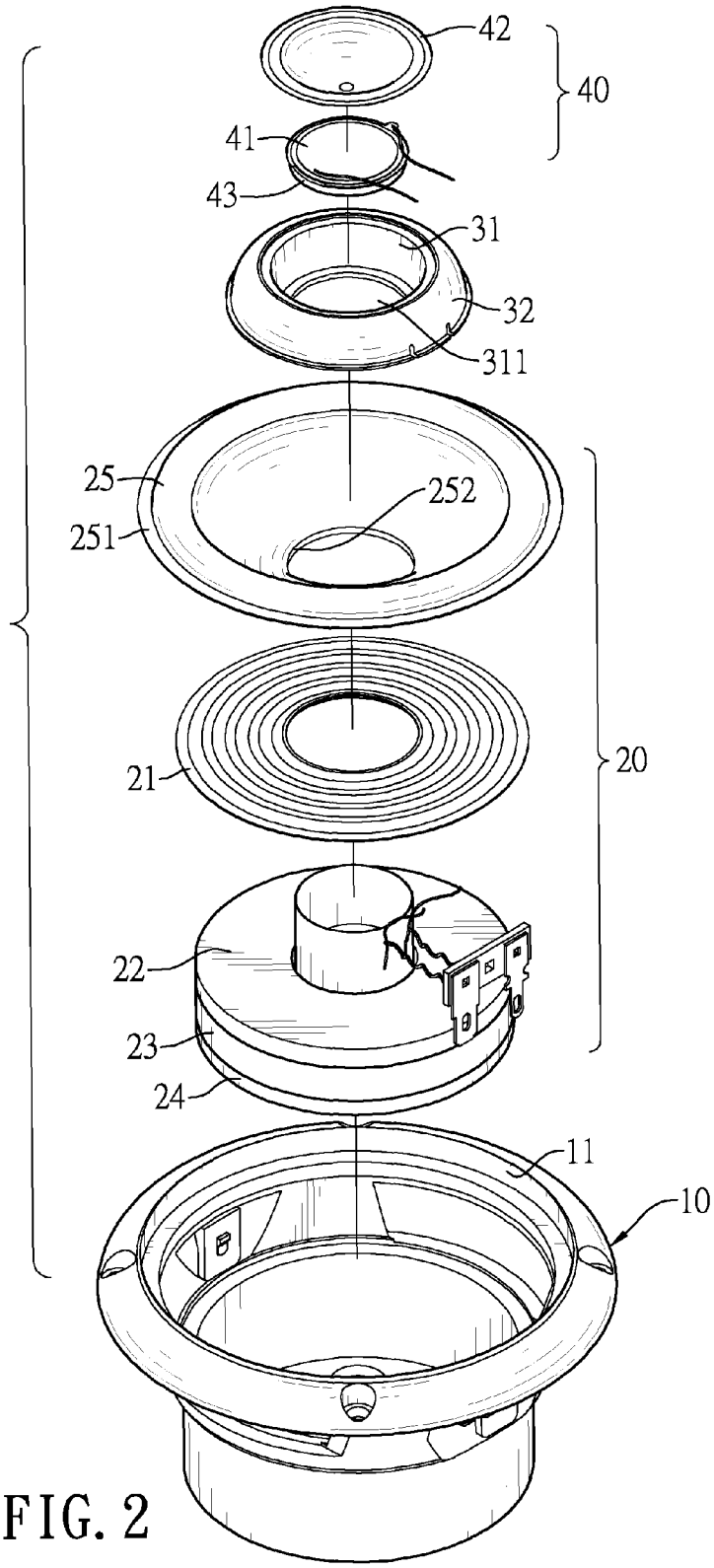
FIG. 2 is an exploded top perspective view of the loudspeaker of FIG. 1.
Figure 3:
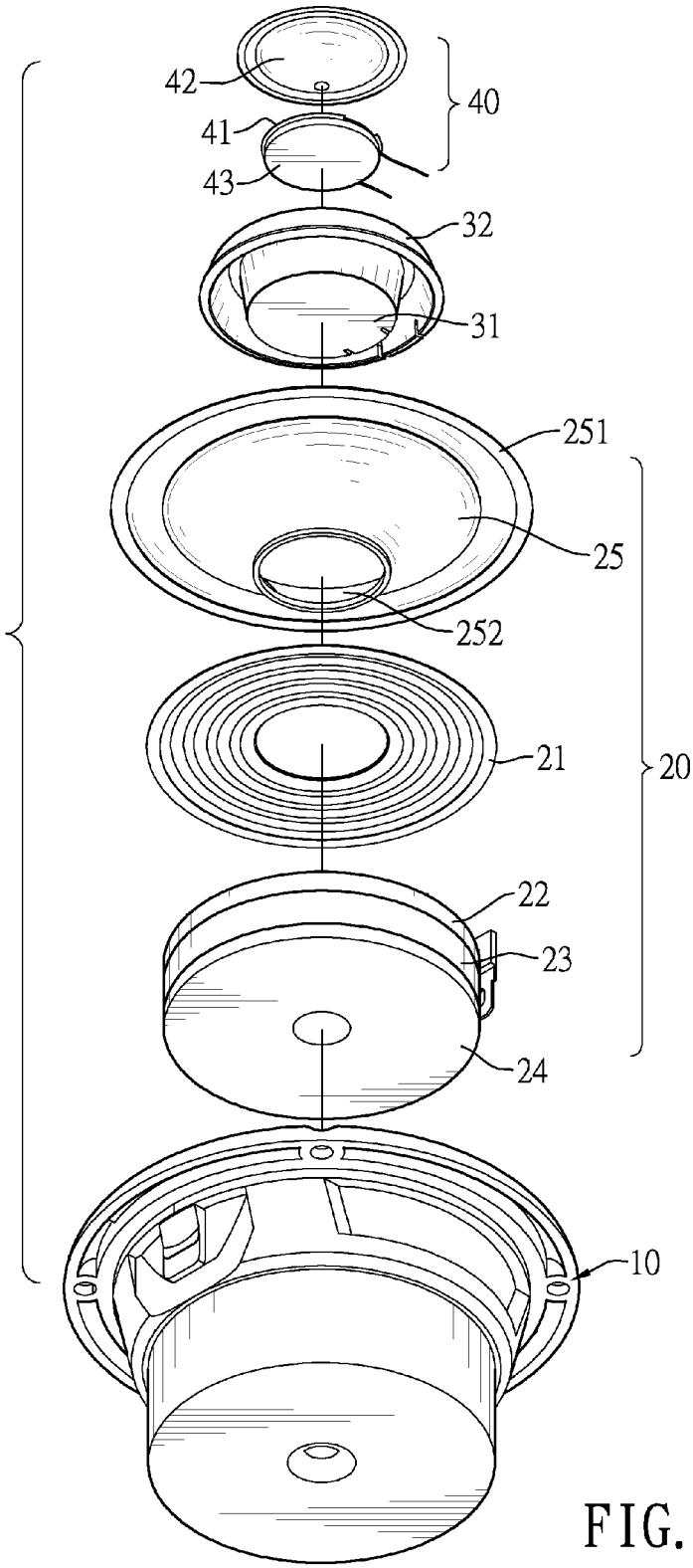
FIG. 3 is an exploded bottom perspective view of the loudspeaker of FIG. 1.
Figure 4:
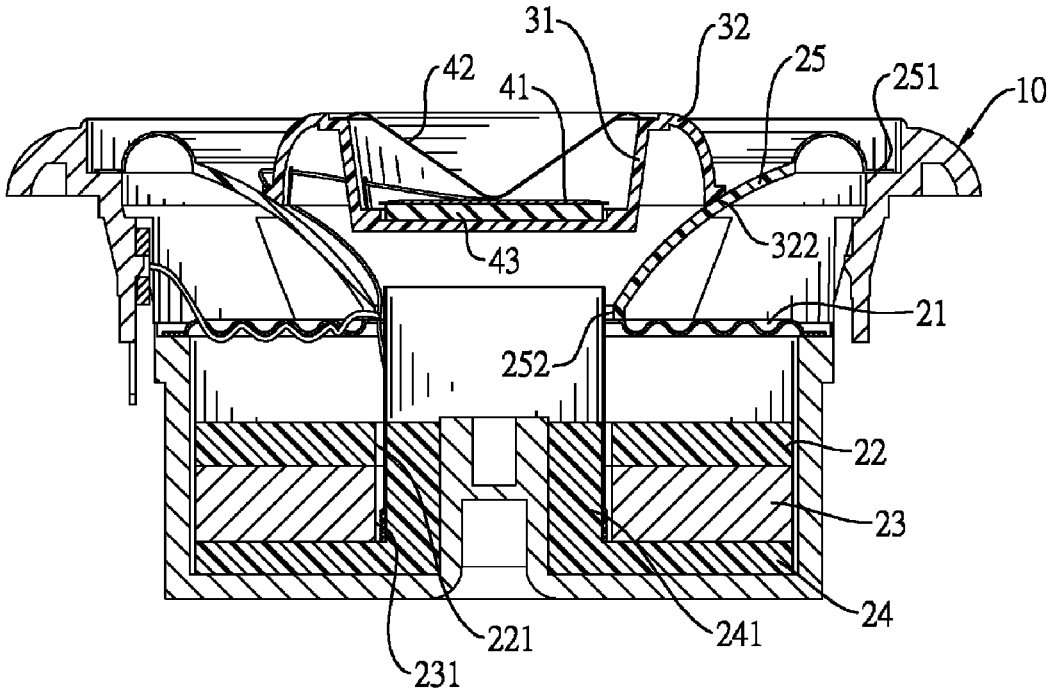
FIG. 4 is a cross-section planar view of the loudspeaker of FIG. 1 of the invention.

With reference to FIGS. 1 to 4, a perspective view of a preferred embodiment of the treble-bass coaxial loudspeaker in accordance with the present invention comprises an inverted conical frame 10, a bass resonance assembly 20, a bass resonance drumhead 25, a bracket 30 and a treble resonance assembly 40.

The inverted conical frame 10 has a top side and a circular opening 11 formed on the top side.

The bass resonance assembly 20 from top to bottom has a wave damping annular board 21, a top yoke 22, a magnet 23 and a bottom yoke 24. A middle portion of the top yoke 22 and a middle portion of the magnet 23 each respectively form a through-hole 221, 231 for a middle convex cylinder 241 of the bottom yoke 24 to penetrate upwardly and to be fastened.

The bass resonance drumhead 25 is in an inverted conical shape. An edge of a top end 251 of the bass resonance drumhead 25 is fastened to an inner edge of the circular opening 11 of the inverted conical frame 10. A bottom end of the bass resonance drumhead 25 forms a center opening 252 to align with the through-hole 231 of the magnet and the through-hole 221 of the top yoke 22 for the bass resonance drumhead 25 to be fastened to the wave damping annular board 21.

The bracket 30 is mounted on the bass resonance drumhead 25 and has a circular cup 31 and a circular side 32. A first side edge 321 of the circular side 32 is connected to a top opening of the circular cup 31, and a second side edge 322 is connected to the bass resonance drumhead 25.

The treble resonance assembly 40 has a treble resonance chip 41, a treble resonance drumhead 42 and an elastomer 43. The elastomer 43 is installed to the bottom of the bracket 30. The treble resonance chip 41 is installed in the bracket 30, and a bottom of the treble resonance chip 41 is mounted on the elastomer 43. A bottom end of the inverted conical treble resonance drumhead 42 is mounted to a top surface of the treble resonance chip 41. An edge of the top end is fastened to a top opening of the bracket 30. The elastomer 43 is mounted on the bottom of the circular cup 31 and can be a sponge preferably. The sponge is adhered to the bottom of the bracket 30 and the bottom of the treble resonance chip 41.

Figure 5:
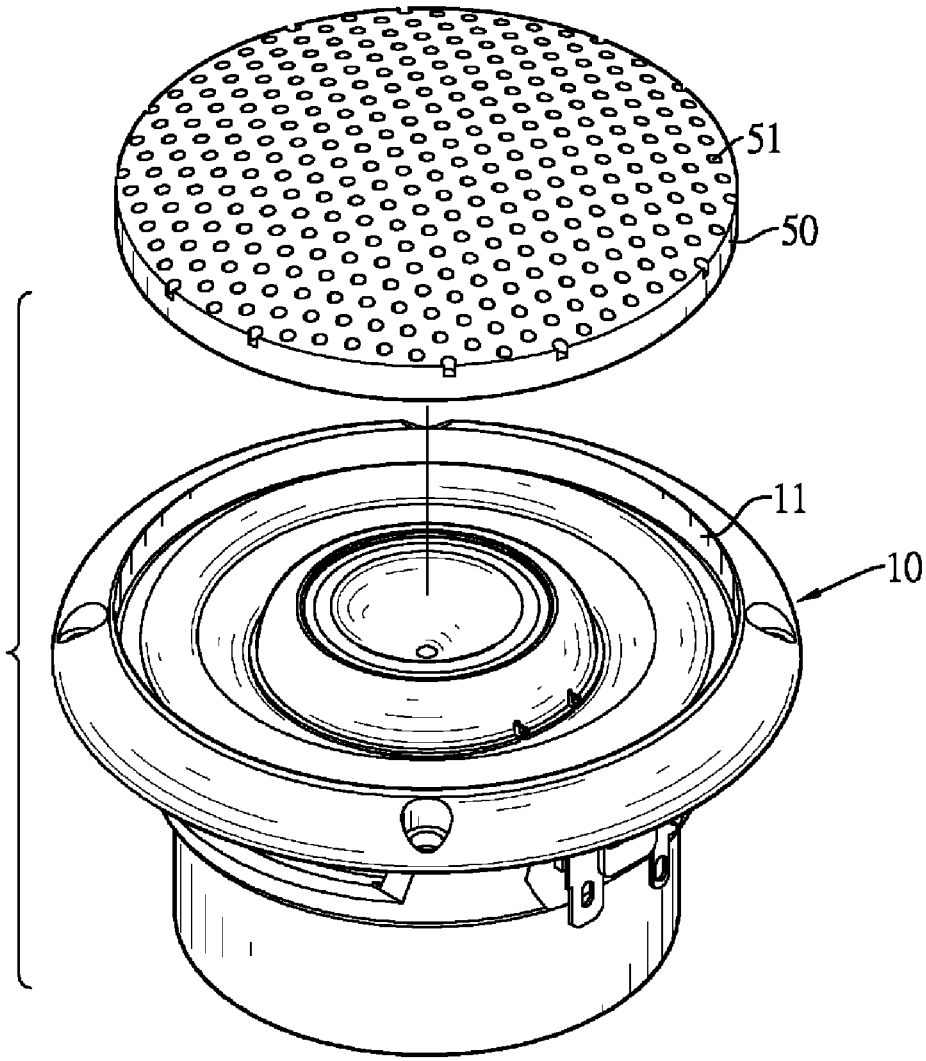
FIG. 5 is a partly exploded perspective view of a second preferred embodiment of a loudspeaker of the invention.

As shown in FIG. 5, a perspective view of another preferred embodiment in accordance with the invention further comprises an anti-dust cover 50. The anti-dust cover 50 is mounted on the circular opening 11 of the inverted conical frame 10 to cover the treble resonance drumhead 42 and the bass resonance drumhead 25 from the dust.

From the above description, a bracket 30 being mounted on the bass resonance drumhead 25 is used for the treble resonance assembly 40 to be mounted inside and to separate the treble resonance chip 41 from the space below between the bass resonance drumhead 25 and the wave damping annular board 21. Thus, when the bass resonance drumhead 25 vibrates, the air turbulence between the bass resonance drumhead 25 and the wave damping annular board 21 decreases destruction of the joint strength between the treble resonance chip 41 and the treble resonance drumhead 42.

Figure 6A:
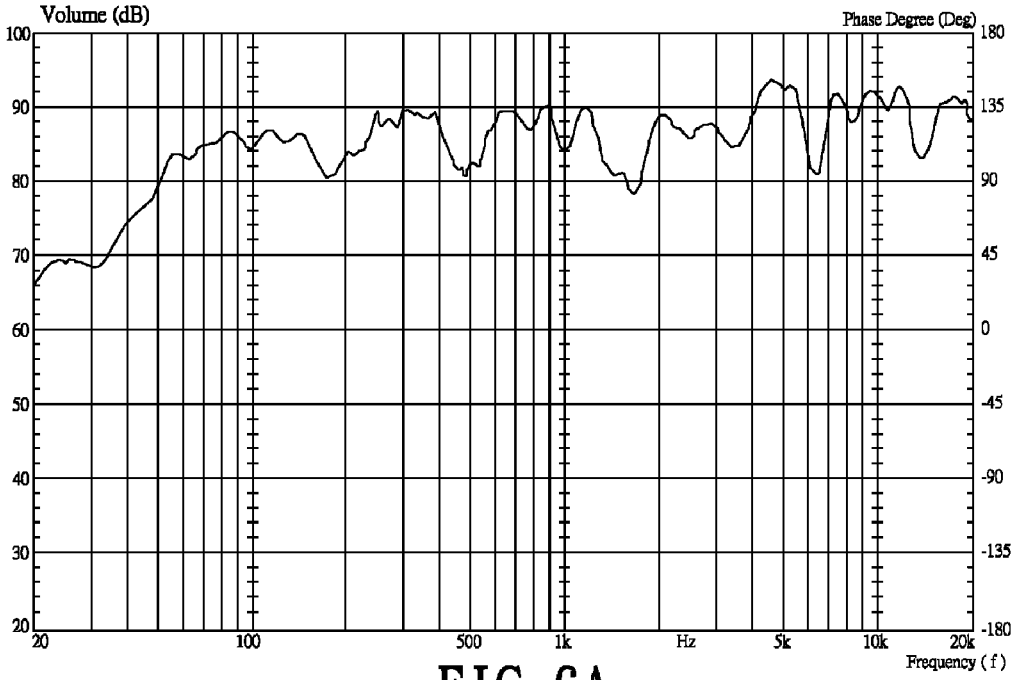
FIG. 6A is a curve diagram showing: volume, phase angle, and frequency measured in the preferred embodiment.
Figure 6B:
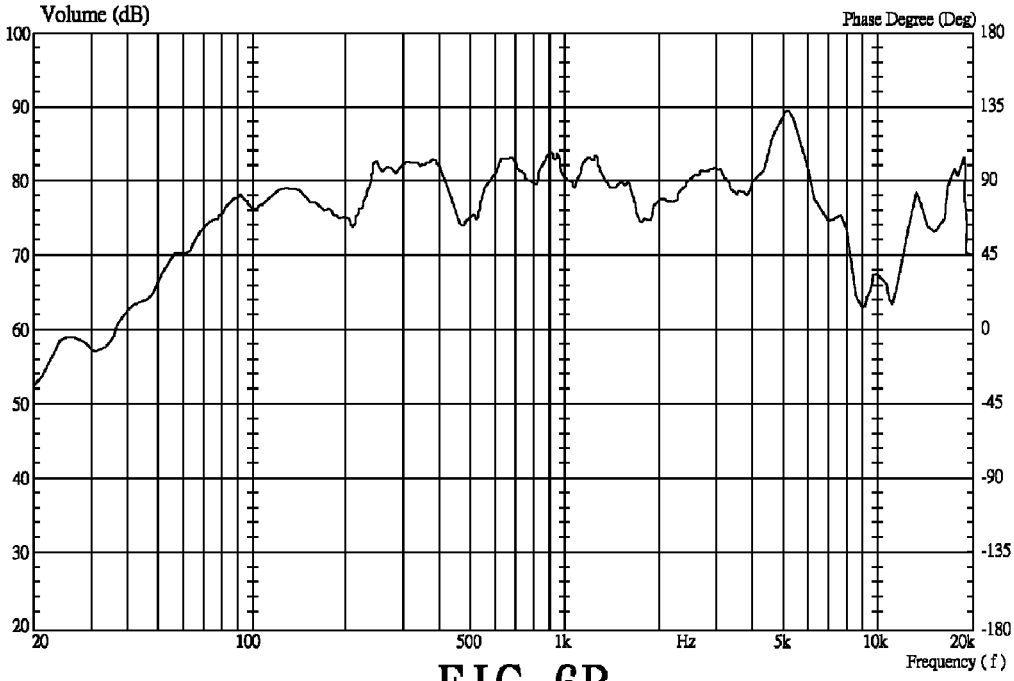
FIG. 6B PRIOR ART
FIG. 6B is a curve diagram showing: volume, phase angle, and frequency measured from the conventional coaxial treble-bass loudspeaker.
Figure 7:
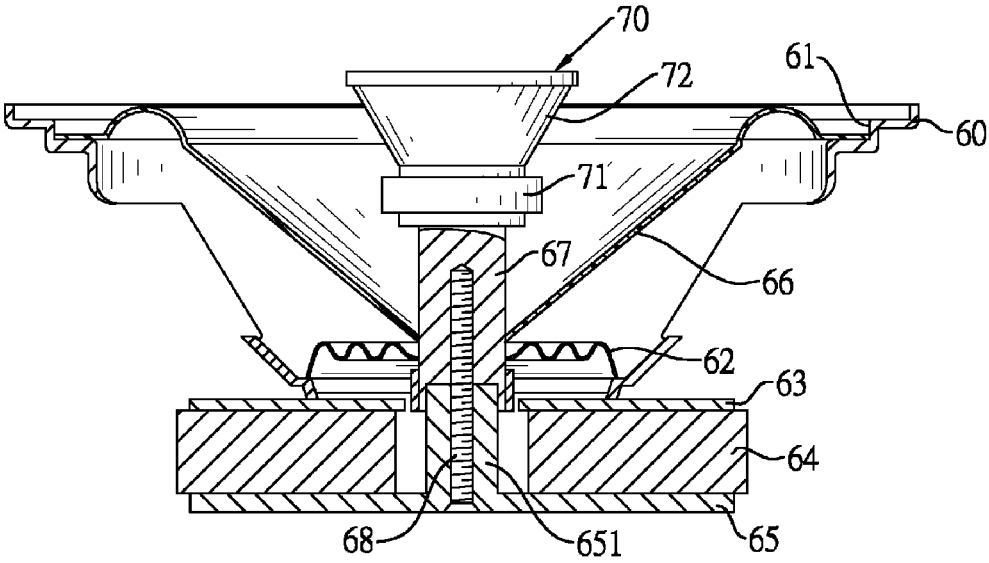
FIG. 7 PRIOR ART
FIG. 7 is a cross-section view of the conventional coaxial treble-bass loudspeaker of FIG. 6B.
Figure 8:
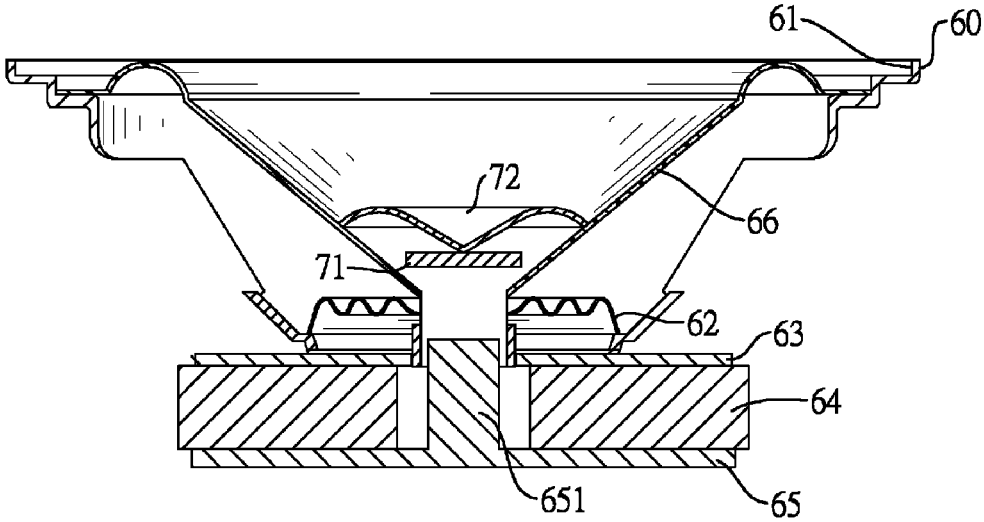
FIG. 8 PRIOR ART
FIG. 8 is a cross-section view of another conventional coaxial treble-bass loudspeaker.

Furthermore, the treble resonance chip is not suspensory in the loudspeaker of the invention. Because the treble resonance chip is separated from the bottom of the bracket by the elastomer and is not in touch with the bracket directly, the treble quality is still excellent. As shown in FIG. 6A and FIG. 6B, the performance of the treble quality at a frequency of 10 KHZ is better than that of a conventional coaxial speaker with the central shaft. Therefore, the treble-bass coaxial loudspeaker in accordance with the present invention can make sure that the joint strength between the treble resonance chip 41 and the treble resonance drumhead 42 is not destroyed by the vibration of the bass resonance drumhead 25.

What is claimed is:

1. A treble-bass coaxial loudspeaker comprising:

a frame having
- a top side; and
- a circular opening formed on the top side;

a bass resonance assembly having
- a wave damping annular board;
- a top yoke;
- a magnet; and
- a bottom yoke;

wherein a middle portion of the top yoke and a middle portion of the magnet each respectively form a through-hole for a middle convex cylinder of the bottom yoke to penetrate upwardly and to be fastened;

a bass resonance drumhead being in an inverted conical shape and having
- a top edge mounted on the inner edge of the top opening of the inverted conical frame; and
- a bottom formed with a center opening that aligns with the through-hole of the magnet and is attached to the wave damping annular board;

a bracket being mounted on the bass resonance drumhead and having an inner bottom and a top opening; and a treble resonance assembly having
- an elastomer being mounted on the inner bottom of the bracket;
- a treble resonance chip being mounted on the elastomer in the bracket; and a treble resonance drumhead having an inverted conical shape, mounted on the treble resonance chip and having a top edge mounted on the top opening of the bracket.

2. The loudspeaker as claimed in claim 1, wherein the bracket has a circular cup having a top opening; and a circular side having
- a top edge connected to the top opening of the circular cup; and
- a bottom edge connected to the bass resonance drumhead.

3. The loudspeaker as claimed in claim 2, wherein the circular cup and the circular side are formed into an integral body, and the side edge of the circular side is adhered to the bass resonance drumhead.

4. The loudspeaker as claimed in claims 3, wherein the elastomer is a sponge.

5. The loudspeaker as claimed in claim 4, wherein the sponge is mounted between the inner bottom of the bracket and the treble resonance chip.

6. The loudspeaker as claimed in claim 5 further comprising an anti-dust cover being mounted on the circular opening of the conical frame to cover the treble resonance drumhead and the bass resonance drumhead.

7. The loudspeaker as claimed in claim 4 further comprising an anti-dust cover being mounted on the circular opening of the conical frame to cover the treble resonance drumhead and the bass resonance drumhead.

8. The loudspeaker as claimed in claim 3 further comprising an anti-dust cover being mounted on the circular opening of the conical frame to cover the treble resonance drumhead and the bass resonance drumhead.

9. The loudspeaker as claimed in claim 2, wherein the elastomer is a sponge.

10. The loudspeaker as claimed in claim 9, wherein the sponge is mounted between the inner bottom of the bracket and the treble resonance chip.

11. The loudspeaker as claimed in claim 10 further comprising an anti-dust cover being mounted on the circular opening of the conical frame to cover the treble resonance drumhead and the bass resonance drumhead.

12. The loudspeaker as claimed in claim 9 further comprising an anti-dust cover being mounted on the circular opening of the conical frame to cover the treble resonance drumhead and the bass resonance drumhead.

13. The loudspeaker as claimed in claim 2 further comprising an anti-dust cover being mounted on the circular opening of the conical frame to cover the treble resonance drumhead and the bass resonance drumhead.

14. The loudspeaker as claimed in claim 1, wherein the elastomer is a sponge.

15. The loudspeaker as claimed in claim 14, wherein the sponge is mounted between the inner bottom of the bracket and the treble resonance chip.

16. The loudspeaker as claimed in claim 15 further comprising an anti-dust cover being mounted on the circular opening of the conical frame to cover the treble resonance drumhead and the bass resonance drumhead.

17. The loudspeaker as claimed in claim 14 further comprising an anti-dust cover being mounted on the circular opening of the conical frame to cover the treble resonance drumhead and the bass resonance drumhead.

18. The loudspeaker as claimed in claim 1 further comprising an anti-dust cover being mounted on the circular opening of the conical frame to cover the treble resonance drumhead and the bass resonance drumhead.

* * * * *